US008674928B2

(12) United States Patent
Lee

(10) Patent No.: US 8,674,928 B2
(45) Date of Patent: Mar. 18, 2014

(54) LIQUID CRYSTAL DISPLAY AND METHOD OF UPDATING SOFTWARE

(75) Inventor: Taewook Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 296 days.

(21) Appl. No.: 12/841,617

(22) Filed: Jul. 22, 2010

(65) Prior Publication Data

US 2011/0148748 A1 Jun. 23, 2011

(30) Foreign Application Priority Data

Dec. 17, 2009 (KR) ..... 10-2009-0126015

(51) Int. Cl.
*G09G 3/36* (2006.01)

(52) U.S. Cl.
USPC ..... 345/102; 345/99

(58) Field of Classification Search
USPC ..... 345/102
See application file for complete search history.

(56) References Cited

U.S. PATENT DOCUMENTS 4,181,943 A * 1/1980 Mercer et al. ..... 701/20
6,680,722 B1 * 1/2004 Hiraki et al. ..... 345/96
7,061,478 B1 * 6/2006 Moyer ..... 345/204
2006/0168236 A1 * 7/2006 Higuma et al. ..... 709/227
2006/0209003 A1 * 9/2006 Kerofsky ..... 345/102
2006/0279517 A1 * 12/2006 Shin et al. ..... 345/102
2008/0231769 A1 * 9/2008 Cho et al. ..... 349/37
2009/0040167 A1 * 2/2009 Sun ..... 345/99
2009/0073109 A1 * 3/2009 Shin et al. ..... 345/102

FOREIGN PATENT DOCUMENTS

KR 20080017280 A 2/2008

OTHER PUBLICATIONS

Office Action issued in corresponding Korean Patent Application No. 10-2009-0126015, mailed Sep. 30, 2013, 3 pages.

* cited by examiner

*Primary Examiner* — Alexander S Beck
*Assistant Examiner* — Mihir Rayan
(74) *Attorney, Agent, or Firm* — Brinks Gilson & Lione

(57) ABSTRACT

The present disclosure relates to a liquid crystal display device including a timing controller and a method for updating the software of the timing controller. The present disclosure suggests liquid crystal display device comprising timing controller including a processor configured to execute software for modulating digital video data to be supplied to the data driving circuit and selecting the backlight dimming data, and a timing control signal generator configured to generate timing control signals to control operating timings of the data driving circuit and the gate driving circuit.

3 Claims, 2 Drawing Sheets

LIQUID CRYSTAL DISPLAY AND METHOD OF UPDATING SOFTWARE

This application claims the priority and the benefit under 35 U.S.C. §119(a) on Patent Application No. 10-2009-0126015 filed in Republic of Korea on Dec. 17, 2009 the entire contents of which are hereby incorporated by reference.

BACKGROUND

1. Field of the Invention

The present disclosure relates to a liquid crystal display device including a timing controller and a method for updating the software of the timing controller.

2. Discussion of the Related Art

An active matrix type liquid crystal display device (or "AMLCD") represents video data using the thin film transistor (or "TFT") as the switching element. As the AMLCD can be made in thin flat panel with lightening weight, nowadays in the display device market, it is replacing cathode ray tube (or "CRT") and applied to portable information appliances, computer devices, office automation appliances, and/or television sets.

The AMLCD comprises a data driving circuit for supplying the data signals to the data lines of the LCD panel, a gate driving circuit for sequentially supplying the gate pulse (or scan pulse) to the gate lines of the LCD panel, and a timing controller for controlling the operating timing of the data driving circuit and the gate driving circuit.

Recently, in order to improve the video quality of the AMLCD, various algorithms are added to the timing controller for compensating or enhancing the video quality. These algorithms are typically applied as hardware methods. However, applying these algorithms with hardware type need much more manufacturing tact time and cost because more times and efforts are required to design, to pack, and to test the timing controller having newly applied algorithm.

BRIEF SUMMARY

A liquid crystal display device comprises: a liquid crystal display panel including a plurality of data lines and a plurality of gate lines crossing each other; a backlight unit radiating backlight to the liquid crystal display panel; a backlight driving circuit turning on and off light sources of the backlight unit according to a backlight dimming data; a data driving circuit converting digital video data into positive and negative data voltages and supplying the positive and the negative data voltages to the plurality of data lines; a gate driving circuit supplying a gate pulse to the plurality of gate lines sequentially; and a timing controller including a processor configured to execute software for modulating digital video data to be supplied to the data driving circuit and selecting the backlight dimming data, and a timing control signal generator configured to generate timing control signals to control operating timings of the data driving circuit and the gate driving circuit.

A method for updating software of the liquid crystal display device according to the present disclosure comprises steps of embedding a processor configured to execute software for modulating digital video data to be supplied to the data driving circuit and selecting the backlight dimming data into a timing controller configure to control operating timings of the data driving circuit and the gate driving circuit; and updating the software using at least one method of which a ROM writer is connected to a non-volatile memory connected to the timing controller, and of which the timing controller is set as a slave device and a host computer connected to the timing controller is set as a master device.

According to the present disclosure, by building (embedding or installing) a processor operated by a software method into the timing controller, the updating the algorithms, i.e. modifying the exist algorithms or adding new algorithms, for driving the liquid crystal display device can be easily and fastly accomplished.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS AND THE PRESENTLY PREFERRED EMBODIMENTS

Figure 1:
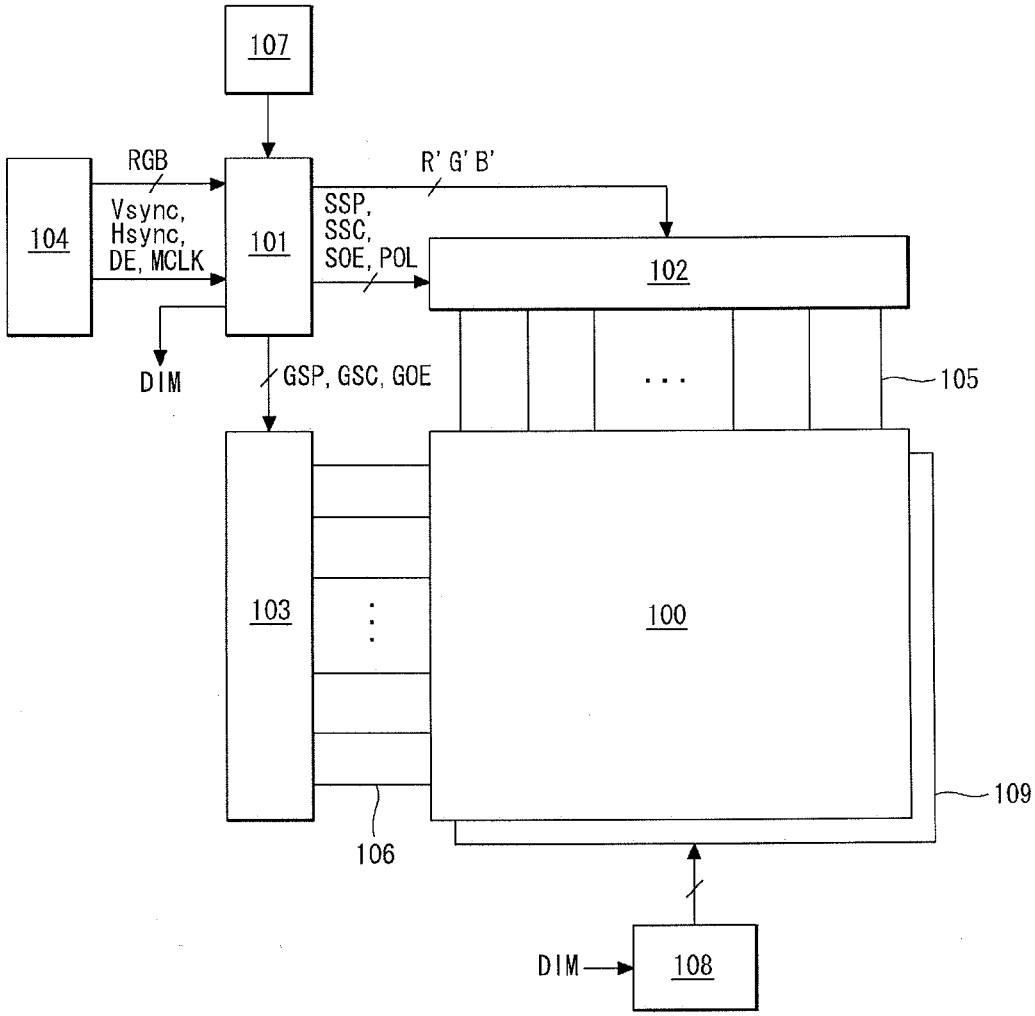
FIG. 1 is a block diagram illustrating a liquid crystal display device according to a preferred embodiment of the present disclosure.

Advantages and features of the present disclosure and a method of achieving the advantages and the features will be apparent by referring to embodiments described below in detail in connection with the accompanying drawings. Hereinafter, referring to the drawings, some preferred embodiments of the present disclosure are explained in detail. However, the present disclosure is not restricted by these embodiments but can be applied to various changes or modifications without changing the technical spirit. In the following embodiments, the names of the elements are selected by considering the easiness for explanation so that they may be different from actual names.

When classifying by the liquid crystal material mode, the LCD according to the present disclosure can be categorized in TN (Twisted Nematic) mode, VA (Vertical Alignment) mode, IPS (In Plane Switching) mode, FFS (Fringe Field Switching) mode and so on. When classifying by the characteristics of transmittance vs voltage, it can be categorized in the NW (Normally White) mode and the NB (Normally Black) mode. In addition, the LCD according to the present disclosure can be any type of LCD device such as the transmissive type LCD, the semi-transissive type LCD, and the reflective type LCD.

Referring to FIG. 1, the LCD according to a preferred embodiment of the present disclosure comprises a liquid crystal display panel 100, a back light unit 109, a backlight driving circuit 108, a timing controller 101, a data driving circuit 102, a gate driving circuit 103, and a host computer 104. The liquid crystal panel 100 comprises two glass substrates joining each other and a liquid crystal layer disposed between the two glass substrates. The liquid crystal layer includes a plurality of liquid crystal cells disposed in matrix type defined by the crossing structure of the data lines 105 and the gate lines 106.

On the lower glass substrate of the liquid crystal display panel 100, a pixel array is formed. The pixel array includes a plurality of data lines 105, a plurality of gate lines 105, a plurality of thin film transistors (or "TFT") and storage capacitors (Cst). The liquid crystal cells are driving by the electric field applied between a pixel electrode connected to the TFT and a common electrode. On the upper glass substrate of the liquid crystal display panel 100, black matrix, color filters and the common electrode are formed. At the each outside of the upper glass substrate and the lower glass substrate, an upper polarizer and a lower polarizer are attached, respectively. At the each inside of the upper glass substrate and the lower glass substrate, alignment layers are formed for setting the pre-tilt angle of the liquid crystal layer.

The backlight unit 109 is disposed under the LCD panel 100. The backlight unit 109 includes a plurality of light source which can be turn on and off by the backlight driving circuit 108, for radiating the backlight to the LCD panel 100. The backlight unit 109 can be a direct type backlight unit or an edge type backlight unit. The light source of the backlight unit 109 can include at least one of HCFL (Hot Cathode Fluorescent Lamp), CCFL (Cold Cathode Fluorescent Lamp), EEFL (External Electrode Fluorescent Lamp), and LED (Light Emitting Diode). The backlight driving circuit 108 turns on and off the light source of the backlight unit 109 with PWM (Pulse Width Modulation) method by responding to the backlight dimming data (or "DIM") which is input from the timing controller 101.

The timing controller 101 receives the digital video data R, G, and B from the host computer 104 via an interface such as LVDS (Low Voltage Differential Signaling) interface or TMDS (Transition Minimized Differential Signaling) interface. The timing controller 101 modulates the digital video data R, G, and B from the host computer 104 according to the algorithm operated by the software, and sends the modulated data to the data driving circuit 102.

The timing controller 101 also receives the timing signals including the vertical synchronizing signal (Vsnyc), the horizontal synchronizing signal (Hsync), the data enable signal (DE), the main clock signal (MCLK) and so on, from the host computer 104 via the LVDS or TMDS interfaces. Referring to the timing information stored in a non-volatile memory 107, the timing controller 101 generates a timing control signals for controlling the operating timing of the data driving circuit 102 and the gate driving circuit 103 based on the timing signals received from the host computer 104. The timing control signals includes a gate timing control signal for controlling the operating time of the gate driving circuit 103, and a data timing control signal for controlling the operating timing of the data driving circuit 102 and the polarity of the data voltage.

The gate timing control signal includes the gate start pulse (GSP), the gate shift clock (GSC), and the gate output enable signal (GOE). The gate start pulse (GSP) is applied to the gate drive IC (or "integrated circuit") generating the first gate pulse to control the shift start timing of the gate drive IC. The gate shift clock (GSC), as the clock signal input to the gate ICs commonly, is the clock signal for shifting the gate start pulse (GSP). The gate output enable signal (GOE) controls the output timings of the gate driving ICs.

The data timing control signal includes the source start pulse (SSP), the source sampling clock (SSC), the polarity control signal (POL), and the source output enable signal (SOE). The source start pulse (SSP) is applied to the source drive IC which will be sampling the first pixel data among the source drive ICs of the data driving circuit 102 to control the shift start timing. The source sampling clock (SSC) is the clock signal for controlling the data sampling timing in the data driving circuit 102 based on rising or falling edge. The polarity control signal (POL) controls the polarity of the data voltage output from the source drive ICs of the data driving circuit 102. If the digital video data to be input into the data driving circuit 102 is sent as being complied with the mini LVDS (Low Voltage Differential Signaling) interface specification, the source start pulse (SSP) and the source sampling clock (SSC) may not be used.

In the non-volatile memory 107, the timing information and the software program required to control the timing control signals, and various parameter information required to operate the software program are stored. The non-volatile memory 107 may be the updatable read-only memory (ROM) such as EEPROM (Electrically Erasable Programmable Read-Only Memory).

In order to improve the responding characteristics of the liquid crystal material, the timing controller 101 can modulate the digital video data using a built-in (embedded) processor according to the amount of the changed input video data. In addition, using the built-in processor, the timing controller 101 analyses the input video data, calculates a representative value of the input video data, and then selects a diming data (DIM) to control the backlight driving circuit 108 for controlling the brightness of the backlight according to the representative value.

The timing controller 101 can drive the LCD panel 100 with the frame frequency of (60×i) Hz by multiplying the factor i (i=integer number larger than 2) to the frame frequency of 60 Hz.

The data driving circuit 102 comprises one or more source drive ICs. Each source drive IC includes the shift register, the latch, the digital-analog converter, and the output buffer. The source drive ICs latch the digital video data R', G', and B' under the controlling of the timing controller 101. The source drive ICs changes the digital video data R', G', and B' convert into both an analog positive data voltage using a positive gamma compensation voltage and an analog negative data voltage using a negative gamma compensation voltage. Each of the source drive IC is connected to the data lines of the LCD panel 100 by the COG (Chip On Glass) process or the TAB (Tape Automated Bonding) process.

The gate driving circuit 103 comprises one or more gate drive ICs. Each gate drive IC includes the shift register, the level shifter, and the output buffer. The gate drive ICs supply the gate pulse (or scan pulse) to the gate lines 106 sequentially by responding to the gate timing control signals. The gate drive ICs of the gate driving circuit 103 can be connected to the gate lines of the lower glass substrate of the LCD panel 100 by the TAB process or can be directly formed on lower glass substrate of the LCD panel 100 by the GIP (Gate In Panel) process.

Figure 2:
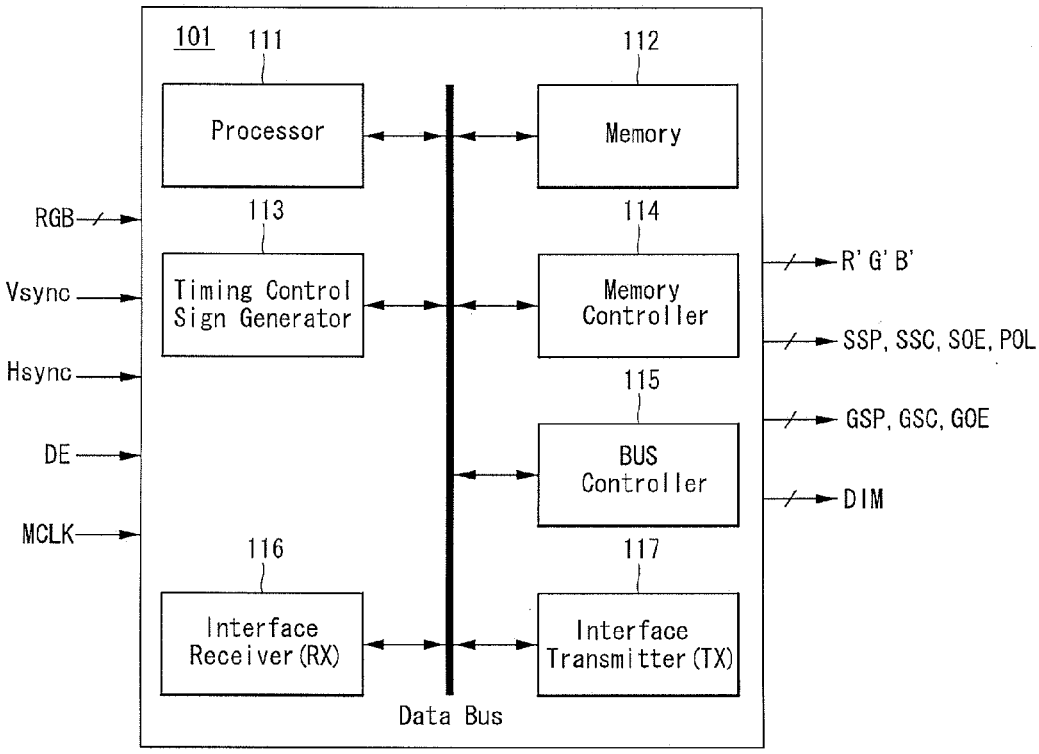
FIG. 2 is a block diagram illustrating the structure of the timing controller shown in the FIG. 1.

The host computer 104 sends the digital video data R, G, and B, and the timing signals (Vsync, Hsync, DE, and CLK) to the timing controller 101 via the interface such as LVDS interface or TMDS interface. FIG. 2 is a block diagram illustrating a structure of the timing controller 101 according to the present disclosure.

Referring to FIG. 2, the timing controller 101 comprises a processor 111, a built-in memory 112, a timing controlling signal generator 113, a memory controller 114, a bus controller 115, an interface receiver 116, and an interface transmitter 117. In addition, the timing controller 101 further comprises a PLL (phase Lock Loop) for multiplying the main clock (CLK) received from the host computer 104.

When the power of the liquid crystal display device turns on, the processor 111 restores or reads the software program stored in the non-volatile memory 107 and then executes the program to process the various algorithms for improving the video quality or the power consumption of the liquid crystal display device. The processor 111 can be at least one of the MCU (Micro Control Unit) and the DSP (Digital Signal Processor). The processor 111 needs not to operate based on the clock.

The algorithms executed by the processor 111 can be implemented by a software method rather than hardware method. Therefore, any type of algorithm can be implemented. For example, in order to improve the responding characteristics of the liquid crystal material, it can be the algorithm in which the input video digital data can be modulated according to the amount of the changed input video digital data. It can be the algorithm for enhancing the contrast characteristics of the video data and for reducing the power consumption of the backlight. Otherwise, it can be the algorithm for compensating the manufacturing process tolerance or the backlight brightness tolerance.

For the algorithms modulating the input digital video data according to the amount of the changed video data in order to improve the response characteristics, there are a plurality of patent applications filed by the same applicant of this disclosure including KR 10-2001-0032364, KR 10-2001-0057119, KR 10-2001-0054123, KR 10-2001-0054124, KR 10-2001-0054125, KR 10-2001-0054127, KR 10-2001-0054128, KR 10-2001-0054327, KR 10-2001-0054889, KR 10-2001-0056235, KR 10-2001-0078449, KR 10-2002-0046858, and KR 10-2002-0074366. The algorithms disclosed by above identified applications modulate the input video data using the look-up table and a plurality of circuit elements. However, the processor 111 according to the present disclosure can modulate the input video data using the software method with the look-up table only.

For the algorithms improving the contrast characteristics of the video and reducing the electric consumption of the backlight, there are a plurality of patent applications filed by the same applicant of this disclosure including KR 10-2003-0099334, KR 10-2004-0030334, KR 10-2003-0041127, KR 10-2004-0078112, KR 10-2003-0099330, KR 10-2004-0115740, KR 10-2004-0049637, KR10-2003-0040127, KR 10-2003-0081171, KR 10-2004-0030335, KR 10-2004-0049305, KR 10-2003-0081174, KR 10-2003-0081175, KR 10-2003-0081172, KR 10-2003-0080177, KR 10-2003-0081173, and KR 10-2004-0030336. The algorithms disclosed by above identified applications modulate the input video data using the look-up table and a plurality of circuit elements, and selects the dimming data. However, the processor 111 according to the present disclosure can modulate the input video data using the software method with the look-up table only.

For the algorithms compensating the brightness and color differences of the backlight and the processing differences, there are a plurality of patent applications filed by the same applicant of this disclosure including KR 10-2005-0097618, KR 10-2005-0100927, KR 10-2005-0100934, KR 10-2005-0117064, KR 10-2005-0109703, KR 10-2005-0118959, and KR 10-2005-118966. The algorithms disclosed by above identified applications modulate the input video data using the look-up table and a plurality of circuit elements, and selects the dimming data. However, the processor 111 according to the present disclosure can modulate the input video data using the software method with the look-up table only.

After modulating the input video data by processing according to the above mentioned algorithms, the processor 111 sends the modulated pixel data R', G', and B' to the data driving circuit 102 via the receiver 114. In addition, the processor 111 analyzes the input video data using the above mentioned algorithms to select the gain values proper to the global dimming, the local dimming, and the backlight driving, selects the backlight dimming value according to the selected gain values, and then modulates the pixel data R', G', and B' using the selected gain values. The backlight dimming data (DIM) generated from the processor 111 will be sent to the backlight driving circuit 108.

When power is turn on, the built-in memory 112 restores the software program and the various parameters required for the software program stored in the non-volatile memory 107, and sends the saved data to the processor 111. The built-in memory 112 may be non-volatile memory such as SDRAM (Synchronous Dynamic Random Access Memory). The memory controller 114 controls the operations for the reading and writing of the built-in memory 112 according to the main clock MCLK.

The timing control signal generator 113 generates the control signals form controlling the operating timing of the driving circuits 102 and 103. The bus controller 115 connects the RGB data bus to the processor 111, the built-in memory 112, the interface receiver 116, and the interface transmitter 117, selectively.

The interface receiver 116 receives the data R, G and B, and the timing signals from the host computer 104. The interface receiver 116 may be a LVDS interface receiving circuit or the TMDS interface receiving circuit. The interface transmitter 117 sends the modulated data R', G' and B' by the processor 111 to the data driving circuit 102. The interface transmitter may be the mini LVDS transmitting circuit.

The timing controller 101 further includes a frequency multiplier (not shown) for multiplying the frequency of the main clock MCLK with an integer number i (i larger than and equal to 2).

The built-in memory 112, the memory controller 114, the timing control signal generator 113, the bus controller 115, the interface receiver 116, and the interface transmitter 117 operates based on the main clock MCLK received from the host computer 104 or the clocks generated by multiplying the main clock MCLK by the frequency multiplier. The processor 111 executes the algorithms by a software method which does not operated based on the hardware clocks.

When the panel characteristics or the driving methods of the LCD panel 100 are changed, the algorithms needs to be modified or a new algorithms may be added to the timing controller 101. For updating the algorithms, a ROM writer is connected to the non-volatile memory 107 the algorithms via an user interface and then the algorithms stored in the non-volatile memory 107 can be modified or a new algorithms may be added to non-volatile memory 107. Alternatively, by setting the host computer 104 and the timing controller 101 as the master and the slave, respectively, and by using the host computer 104, the algorithms can be modified or a new algorithm may be added to the processor 111 of the timing controller 101.

While the embodiment of the present invention has been described in detail with reference to the drawings, it will be understood by those skilled in the art that the invention can be implemented in other specific forms without changing the technical spirit or essential features of the invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

The invention claimed is:

1. A liquid crystal display device comprising:

a liquid crystal display panel including a plurality of data lines and a plurality of gate lines crossing each other;

a backlight unit that radiates backlight to the liquid crystal display panel;

a backlight driving circuit that turns on and off light sources of the backlight unit according to backlight dimming data;

a data driving circuit that converts digital video data into positive and negative data voltages and supplying the positive and the negative data voltages to the plurality of data lines;

a gate driving circuit that supplies a gate pulse to the plurality of gate lines sequentially;

a timing controller including a processor configured to execute at least one software that modulates the digital video data to be supplied to the data driving circuit, such that the modulated digital video data enhances pixel contrast and reduces power consumption of the backlight unit, and selects the backlight dimming data according to gain values proper to global dimming and local dimming, and a timing control signal generator configured to generate timing control signals to control operating timings of the data driving circuit and the gate driving circuit; and a host computer configured to supply the digital video data and external timing control signals to the timing controller, wherein the processor operates regardless of the external timing control signals, and includes at least one of a Micro Control Unit (MCU) and a Digital Signal Processor (DSP), and wherein the timing controller further includes:

a built-in memory that restores data from the non-volatile memory when power is turn on;

a memory controller configured to control reading and writing operations of the built-in memory;

an interface receiving circuit configured to receive the digital video data and the external timing control signals from the host computer;

an interface transmitting circuit configured to send the digital video data modulated by the processor to the data driving circuit; and a bus controller configured to connect the plurality of data lines supplied with the digital video data received from the interface receiver to one of the processor, the built-in memory, and the interface receiver, selectively.

2. The device according to the claim 1, wherein the timing control signal generator generates timing control signals that control the operating timings of the data driving circuit and the gate driving circuit using the external timing control signals.

3. The device according to the claim 2, further comprising a non-volatile memory configured to store the software, parameters required for the software, and pulse information of the timing control signals.

* * * * *